US008019104B2

(12) United States Patent
Klinkby et al.

(10) Patent No.: US 8,019,104 B2
(45) Date of Patent: Sep. 13, 2011

(54) HEARING AID WITH FEEDBACK MODEL GAIN ESTIMATION

(75) Inventors: Kristian Tjalfe Klinkby, Varlose (DK); Helge Pontoppidan Foeh, Stenlose (DK); Thilo Volker Thiede, Ballerup (DK)

(73) Assignee: Widex A/S, Lynge (DK)

( * ) Notice: Subject to any disclaimer, the term of this patent is extended or adjusted under 35 U.S.C. 154(b) by 1124 days.

(21) Appl. No.: 11/763,767

(22) Filed: Jun. 15, 2007

(65) Prior Publication Data

US 2008/0273728 A1 Nov. 6, 2008

Related U.S. Application Data

(63) Continuation-in-part of application No. PCT/EP2004/053547, filed on Dec. 16, 2004.

(51) Int. Cl.
*H04R 25/00* (2006.01)

(52) U.S. Cl. ..... 381/317; 381/318

(58) Field of Classification Search ..... 381/312, 381/315, 317, 318, 321
See application file for complete search history.

(56) References Cited

U.S. PATENT DOCUMENTS 7,489,789 B2 * 2/2009 Kaulberg ..... 381/317

FOREIGN PATENT DOCUMENTS

EP 0 843 502 5/1998
WO WO 02/25996 A1 3/2002

OTHER PUBLICATIONS

Chankawee et al, "On the Improvement of acoustic feedback cancellation in hearing-aid devices", Circuits and Systems, 2004. MWSCAS '04. The 2004 47th Midwest Symposium on Hiroshima, Japan, Jul. 25-28, 2004, Piscataway, NJ, USA, IEEE, vol. 2 Jul. 25, 2004, pp. 1117-1120, XP010738694.

* cited by examiner

*Primary Examiner* — Brian Ensey
(74) *Attorney, Agent, or Firm* — Sughrue Mion, PLLC

(57) ABSTRACT

A hearing aid includes an input transducer for transforming an acoustic input signal into an electrical input signal, a processor for generating an electrical output signal by amplifying the electrical input signal with a processor gain, an output transducer for transforming the electrical output signal into an acoustic output signal, an adaptive feedback suppression filter for generating a feedback cancellation signal, and a model gain estimator generating an upper processor gain limit and for providing a control parameter indicating a possible misadjustment of the model.

27 Claims, 4 Drawing Sheets

HEARING AID WITH FEEDBACK MODEL GAIN ESTIMATION

RELATED APPLICATIONS

The present application is a continuation-in-part of International application No. PCT/EP2004/053547, filed on Dec. 16, 2004, with The European Patent Office and published as WO 2006/063624 A1.

BACKGROUND OF THE INVENTION

1. Field of the Invention

The invention relates to the field of hearing aids. More specifically, the invention relates to a hearing aid with an adaptive filter for suppression of acoustic feedback. The invention also relates to a method of adjusting the signal path gain and to an electronic circuit for a hearing aid. The invention further relates to a hearing aid having means for measuring the spectral gain in an adaptive feedback suppression filter, to a method of measuring the spectral gain in the adaptive feedback suppression filter, and to an electronic circuit for such a hearing aid.

2. The Prior Art

Acoustic feedback occurs in all hearing instruments when sounds leak from the vent or seal between the ear mould and the ear canal. In most cases, acoustic feedback is not audible. But when in-situ gain of the hearing aid is sufficiently high, or when a larger than optimal size vent is used, the output of the hearing aid generated within the ear canal can exceed the attenuation offered by the ear mould/shell. The output of the hearing aid then becomes unstable and the once-inaudible acoustic feedback becomes audible, e.g. in the form of ringing, whistling noise or howling. For many users and the people around, such audible acoustic feedback is an annoyance and even an embarrassment. Feedback also distorts signal processing and limits the gain available for the user.

Audible feedback is a sign of instability of the hearing instrument system. In Cook, F.; Ludwigsen, C.; and Kaulberg, T.: "Understanding feedback and digital feedback cancellation strategies", The Hearing Review, February 2002; Vol. 9, No 2, pages 36, 38-41, 48 and 49, there are suggested two possible solutions to regain stability. One solution is to control the signal feeding back to the microphone by controlling the leakage factor $\beta$. The other is to reduce gain G of the hearing instrument.

Managing feedback by gain reduction is in particular a problem in linear hearing aids. Most linear hearing aids are adapted for greater gain in the high frequencies, where the hearing deficiency tends to be more profound. Unfortunately, the typical feedback path also provides less attenuation at high frequencies than at low frequencies. Therefore, the risk of audible feedback is highest in the higher frequency range. One common method to control feedback is to lower the high frequency gain of the hearing aid through the use of tone control or low pass filtering. However, gain in the higher frequency regions is also compromised with this approach. Speech intelligibility may suffer as a consequence.

An additional problem with managing feedback in linear hearing aids is that these devices provide the same gain at all input levels, so that a gain constraint that is imposed to combat feedback will be effective at all input levels. This means that soft sounds, as well as medium-level sounds will be affected to the same extent. Speech intelligibility at all input levels may be affected. Feedback may necessitate lowering the gain over a wide frequency range, even though the feedback signal may originate in a narrow frequency band only.

In case of a more sophisticated hearing aid, it may be possible to lower the gain in a selected narrow frequency range. However, an assumption behind the "narrow-band gain reduction" approach to feedback management is that there is only one fixed feedback frequency. In reality, such an assumption is seldom true. Typically, there is more than one frequency at which instability occurs. Suppressing one frequency may create feedback at another frequency, as it is described, e.g. in Agnew, J.: "Acoustic feedback and other audible artefacts in hearing aids", Trends in Amplification, 1996; 1 (2): pages 45-82.

A non-linear or a compression hearing aid is capable of providing less gain at higher input levels. In case of a feedback tone, the compression feature kicks in to control the level of the signal, however the feedback tone will not be removed by the compressor.

Generally, the feedback path is not stationary; it is dynamically modified by the state of the hearing aid instrument wearer. Consequently, feedback may arise during normal service, even though the fitter has been careful in testing the fit in the clinic and has attempted to set safe gain limits.

In WO 94/09604, a hearing aid with digital, electronic compensation for acoustic feedback is disclosed. The hearing aid comprises a digital compensation circuit comprising a noise generator for the insertion of noise, and an adjustable, digital filter, which is adapted to the feedback signal. The adaptation takes place using a correlation circuit. The digital compensation circuit further comprises a digital circuit which monitors the loop gain and regulates the hearing aid amplification via a digital summing circuit, so that the loop gain is less than a constant K. This is done by evaluating the coefficients in the adaptive filter and continuously computing the amplification in the adaptive filter at different frequencies.

However, it is not possible to directly measure or monitor the loop gain in a hearing aid by means of a feedback suppression filter. The feedback suppression filter can only be used for an estimate of the acoustic feedback gain. In an ideal situation, wherein the feedback suppression filter removes 100% of the feedback component in the input signal, the corresponding allowable processor gain will be infinite. In a non-ideal situation, there will always be some amount of residual feedback. This residual feedback is determining the actual allowable processor gain. There are, e.g. in WO 02/25996, proposals on how to determine this residual feedback and thereby the allowable processor gain. However, such methods for determining allowable processor gain are expensive in hardware and it is also necessary to have access to the current coefficients of the feedback suppression filter.

SUMMARY OF THE INVENTION

On this background, it is an object of the present invention to provide an adaptive system and, in particular, a hearing aid with an adaptive filter for suppression of acoustic feedback, and a method of the kind defined, in which the deficiencies of the prior art are remedied, and, in particular, to provide an adaptive system and a method of the kind defined which allow to prevent feedback howling without monitoring the loop gain and evaluating of filter coefficients in the adaptive feedback suppression filter.

The present invention overcomes the foregoing and other problems by providing a hearing aid and a method of adjusting the signal path gain of a hearing aid. More specifically the invention in a first aspect provides a hearing aid comprising an input transducer transforming an acoustic input signal into an electrical input signal, a processor generating an electrical output signal by amplifying said electrical input signal according to a processor gain, an output transducer transforming said electrical output signal into an acoustic output signal, an adaptive feedback suppression filter generating a feedback cancellation signal, and a model gain estimator determining a model gain estimate of the adaptive feedback suppression filter and generating an upper limit of said processor gain, said model gain estimator including a model evaluation block providing a control parameter indicating a possible misadjustment of the model.

Methods, apparatuses, systems and articles of manufacture like computer program products and electronic circuits consistent with the present invention determine the gain in the adaptive feedback suppression filter (from now on also referred to as the "model gain") and use this model gain to derive an upper processor or signal path gain limit.

Preferably, the model gain is continuously determined in order to cope with different fluctuating acoustic environmental surroundings and at the same time to allow maximum desired processor gain in the hearing aid, so that a time varying processor gain constraint imposed is safe without being overly restrictive.

According to an aspect of the present invention, a hearing aid comprises an input transducer for transforming an acoustic input signal into an electrical input signal, a processor for generating an electrical output signal by amplifying the electric input signal according to a processor gain, an output transducer for transforming the electrical output signal into an acoustic output signal, an adaptive feedback suppression filter for generating a feedback cancellation signal out of the electrical output signal by using an error signal generated from the difference between the feedback cancellation signal and the electrical input signal, and a model gain estimator generating an upper processor gain limit by determining the gain in the adaptive feedback suppression filter.

According to an embodiment of the present invention, the determination of the gain in the adaptive feedback suppression filter (the model gain) is carried out by comparing the level of the electrical output signal to the level of the feedback cancellation signal. The level of each of these signals is, e.g., estimated as a norm within a selected window. The derived level difference between the electrical output signal and the feedback cancellation signal is then used as an estimate for the model gain. Thus, the upper gain limit in the processor is determined by merely estimating the acoustic feedback gain and not by trying to estimate the loop gain in the hearing aid.

However, if the step size and length of the adaptive feedback suppression filter is known, it is possible to estimate the precision within which the adaptive feedback suppression filter can match the acoustic feedback, i.e., it can be estimated that the acoustic feedback compensation leaves a residual feedback relative to the feedback cancellation signal. Thus, it can be estimated how much the loop gain probably will be reduced. From this estimate it is possible to derive an offset, i.e. a safety margin, which, added to the gain limit derived from the acoustic feedback gain, yields an appropriate upper processor gain limit. According to an embodiment of the present invention, the upper processor gain limit may therefore be determined by the precision of the adaptive feedback suppression filter, the feedback cancellation signal and the safety margin.

According to a preferred embodiment of the present invention, spectral signal path gains of the processor are adjusted in accordance with respective time varying upper gain limits. These spectral upper gain limits are obtained by measuring the spectral acoustic feedback gains in the adaptive feedback suppression filter. Spectral gains are necessary when the signal paths of the respective signals in the hearing aid are split into two or more frequency bands. For example, the electrical input signal is split into different frequency bands before being inputted to the processor, implying that the processor has to estimate two or more spectral gains according to the frequency bands of the electrical input signal. In that case it is also necessary to differentiate the model gain estimate into an equal number of frequency bands in order to derive upper gain limits for each frequency band. Normally, the processor is preceded by, e.g., an FFT-circuit or an input signal filter bank splitting the electrical input signal into respective frequency bands. It is therefore possible to calculate the spectral acoustic feedback gains with exactly the same bandwidth by the processor in the signal path by using the same filter bank or FFT-circuit and thereby reducing the error of the estimate.

According to the present invention, the upper gain limit is derived from the model gain determination, which is done by comparing the input (electrical output signal) and the output (feedback cancellation signal) of the adaptive feedback suppression filter but not by using the filter coefficients themselves. It is therefore possible to estimate the upper gain limit independently of the chosen embodiment of the adaptive feedback suppression filter.

According to a preferred embodiment in which the processor is preceded by the input signal filter bank splitting the electrical input signal into two or more frequency bands, the model gain estimator performs spectral equivalent model gain estimation in these frequency bands. For that purpose, the feedback cancellation signal and the electrical output signal are fed into their respective filter banks of the model gain estimator. The output of each filter bank is a signal vector from which a level measure is taken. In a filter gain estimator block of the model gain estimator a ratio is determined between these level measures taken before and after the model, and a gain estimate in each frequency band is obtained. These estimates are now used as spectral upper gain limits in the processor.

According to a preferred embodiment, the level measure is taken by calculating a weighted average of the absolute value of each signal in the signal vector over a certain time window as a so called norm.

According to another preferred embodiment, the level measure is taken by calculating a simple average of the absolute value of each signal in the signal vector over a certain time, i.e., the time window is a rectangular window.

According to another embodiment, the average of the absolute value of a signal is calculated by a first order low pass filter, i.e., the time window is exponential.

According to still another embodiment, the level measure is taken by computing an energy measure, i.e. calculating an average of the squared values of each signal in the signal vector over a certain time window, where said window either is rectangular or exponential.

The result of adjusting the spectral signal path gain or gains by means of time varying feedback model gain estimates is to increase the stability of the hearing aid. In case the adaptive feedback suppression filter (also referred to as the model) produces a feedback cancellation signal that corresponds to or is at least close to the acoustic feedback signal, the model has converged correctly and the feedback component of the electrical input signal will be reduced, thereby increasing the stability margins in all frequency bands. As a result, larger processor gains are possible. At the same time, the model gain estimates will become more accurate. This means, that upper gain limits can be less restrictive, and it is possible to increase these with some amounts, depending on the accuracy of the model. However, it is advisable to select the upper gain somewhat lower than required to achieve stability, because gains close to the upper limit can result in unpleasant audible effects.

According to a preferred embodiment, the model gain estimator comprises a model evaluation block to measure the accuracy of the model. Measuring the accuracy of the model is necessary because if the model is misadjusted the estimated model gains will be unreliable. If the model is misadjusted, relevant precautions can be taken. The model evaluation block does this by delivering respective control parameters to the filter gain estimator. The control parameters may thereby control the filter gain estimator, e.g. freeze the gain estimates in a certain time period or make the gain limits leak towards their default values, which, e.g., may have been measured when fitting the hearing aid.

According to an embodiment of the present invention, the accuracy of the model is measured by comparing a norm of the electrical input signal without feedback compensation with a norm of the feedback controlled electrical input signal. The feedback controlled electrical input signal is the electrical input signal from which the feedback cancellation signal is subtracted. If the norm of the electrical input signal without feedback compensation is smaller than the norm of the feedback controlled electrical input signal which means that the subtraction actually increases the norm of the input signal, the model is most likely misadjusted and, as a result of this, the gain estimation block is frozen, blocked, or other precautions are taken. A model evaluation device which compares the norm of the electrical input signal with the norm of the feedback controlled electrical input signal is disclosed in co-pending patent application PCT/EP03/09301, filed on 21 Aug. 2003, and published as WO-A1-2005/020632, the contents of which are incorporated here into by reference.

The present invention further provides a method of adjusting the spectral signal path gain or gains by means of time varying feedback model gain estimates.

The present invention, in a second aspect, provides a method of adjusting the signal path gain of a hearing aid comprising selecting an input transducer transforming an acoustic input signal into an electrical input signal, a processor generating an electrical output signal by amplifying said electrical input signal with said signal path gain, and an output transducer transforming said electrical output signal into an acoustic output signal, generating a feedback cancellation signal by an adaptive feedback suppression filter, determining a model gain estimate of the adaptive feedback suppression filter by evaluating said feedback cancellation signal, generating an upper limit of said signal path gain by said model gain estimate upon evaluation of said feedback cancellation signal and said electrical output signal and providing a control parameter indicating a possible misadjustment of the model.

The invention, in a third aspect, provides a computer program comprising program code for performing a method of adjusting the signal path gain of a hearing aid comprising selecting an input transducer transforming an acoustic input signal into an electrical input signal, a processor generating an electrical output signal by amplifying said electrical input signal with said signal path gain, and an output transducer transforming said electrical output signal into an acoustic output signal, generating a feedback cancellation signal by an adaptive feedback suppression filter, determining a model gain estimate of the adaptive feedback suppression filter by evaluating said feedback cancellation signal, generating an upper limit of said signal path gain by said model gain estimate upon evaluation of said feedback cancellation signal and said electrical output signal and providing a control parameter indicating a possible misadjustment of the model.

The invention, in a fourth aspect, provides an electronic circuit for a hearing aid comprising: a processor circuit generating an electrical output signal by amplifying an electrical input signal submitted by an input transducer of said hearing aid with a processor gain, an adaptive feedback suppression filter circuit generating a feedback cancellation signal to be subtracted from said electrical input signal before said electrical input signal is provided to said processor circuit, a model gain estimation circuit determining a model gain estimate of the adaptive feedback suppression filter and generating an upper limit of said processor gain, and said model gain estimation circuit including a model evaluation block providing a control parameter indicating a possible misadjustment of the model.

Further aspects and variations of the invention are defined by the dependent claims.

BRIEF DESCRIPTION OF THE DRAWINGS

The present invention and further features and advantages thereof will be more readily apparent from the following detailed description of particular embodiments of the invention with reference to the drawings, in which.

DETAILED DESCRIPTION OF THE INVENTION

Figure 4:
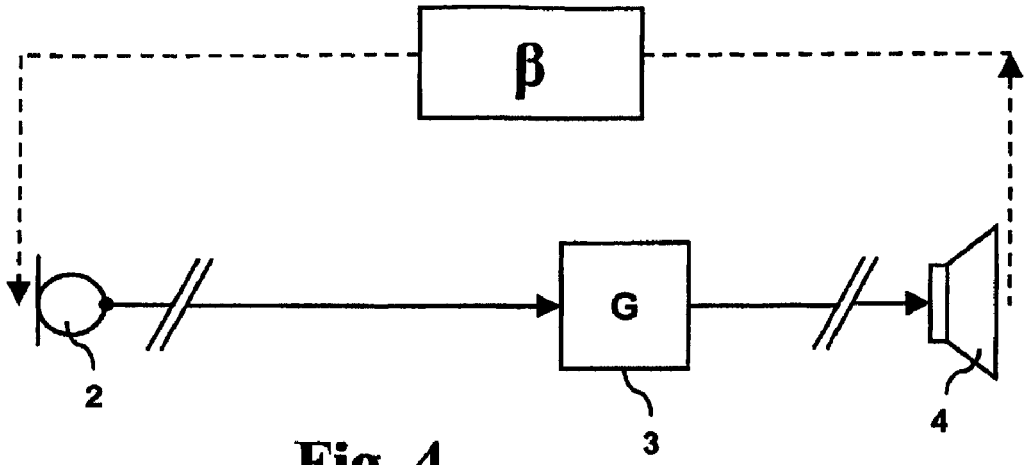
FIG. 4 depicts a block diagram illustrating the acoustic feedback path of a hearing aid according to the prior art.

Reference is first made to FIG. 4, which shows a simple block diagram of a hearing aid comprising an input transducer or microphone 2 transforming an acoustic input signal into an electrical input signal, a signal processor 3 amplifying the input signal and generating an electrical output signal and an output transducer or receiver 4 for transforming the electrical output signal into an acoustic output signal. The acoustic feedback path of the hearing aid is depicted by broken arrows, whereby the attenuation factor is denoted by $\beta$. If, in a certain frequency range, the loop gain, i.e. the product of the gain denoted by G (including transformation efficiency of microphone and receiver) of the processor 3 and attenuation $\beta$ equates or exceeds 1, audible acoustic feedback occurs.

Figure 5:
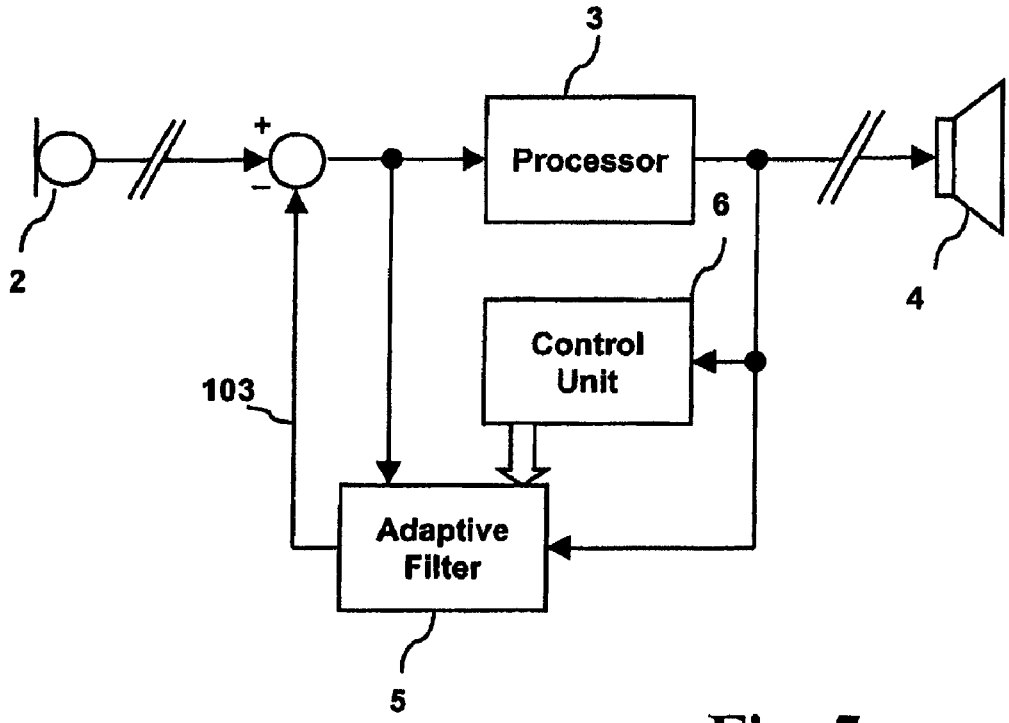
FIG. 5 depicts a block diagram showing a prior art hearing aid.

To suppress such undesired feedback it is well-known in the art to include an adaptive filter in the hearing aid to compensate for the feedback. Such a system is schematically illustrated in FIG. 5. The output signal from signal processor 3 is fed to an adaptive filter 5. The adaptive filter processes the processor output signal according to internal filter coefficients to generate a feedback cancellation signal 103. The filter coefficients include delay capabilities by which the filter can mimic the acoustic delay from the receiver to the microphone. The feedback cancellation signal is subtracted from the microphone input signal to produce the processor input signal. The adaptive filter continuously monitors the processor output signal as well as the processor input signal, seeking to adapt the internal filter coefficients so as to continuously produce a cancellation signal that will minimise the cross-correlation between the processor input signal and the processor output signal. A filter control unit 6 controls the adaptive filter, e.g. the adaptation rate or speed of the adaptive filtering. Hereby the adaptive filter mimics the feedback path, i.e. it estimates the transfer function from output to input of the hearing aid, including the acoustic propagation path from the output transducer to the input transducer.

Figure 1:
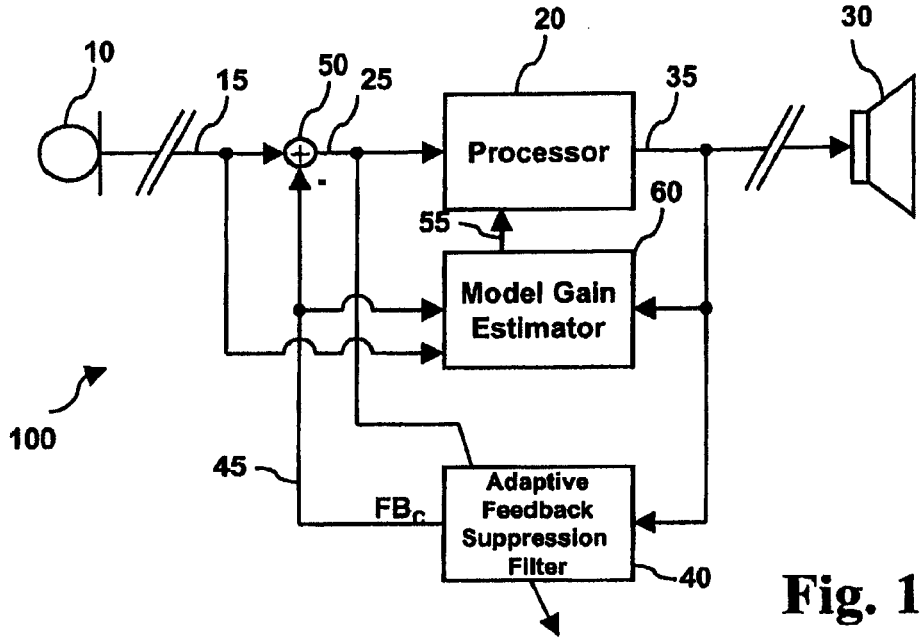
FIG. 1 depicts a block diagram of a hearing aid according to a first embodiment of the present invention.

Reference is now made to FIG. 1, which shows a block diagram of a first embodiment of a hearing aid according to the present invention.

The signal path of the hearing aid 100 comprises an input transducer or microphone 10 transforming an acoustic input signal into an electrical input signal 15 by, e.g., converting the sound signal to an analogue electrical signal, an A/D-converter (not shown) for sampling and digitising the analogue electrical signal into a digital electrical signal, and an input signal filter bank (not shown in FIG. 1) for splitting the input signal into a plurality of frequency bands. The signal path further comprises a processor 20 for generating an amplified electrical output signal 35 and an output transducer (loud speaker, receiver) 30 for transforming the electrical output signal into an acoustic output signal. The amplification characteristic of the processor 20 may be non-linear, e.g. it may show compression characteristics as it is well-known in the art, providing more gain at low signal levels.

Figure 2:
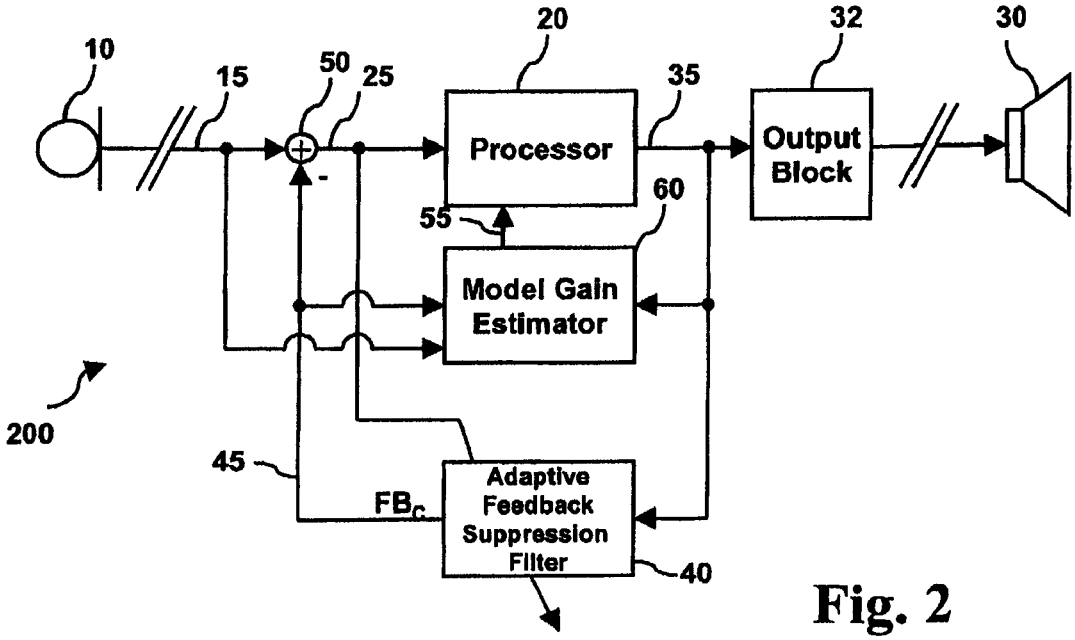
FIG. 2 depicts a block diagram of a hearing aid according to a second embodiment of the present invention.

In FIG. 2, a block diagram of a second embodiment of a hearing aid according to the present invention is shown. The hearing aid 200 is almost the same as the one shown in FIG. 1 but further comprises an output block 32 in the signal path. The electrical output signal 35 generated by processor 20 is fed to the output block 32 and then from the output block to the output transducer 30. The output block 32 introduces a delay to the electrical output signal and so to the acoustic output signal which makes it easier for the adaptive feedback suppression filter to distinguish between input signal, output signal and feedback signal of the hearing aid and, with that, to estimate the acoustic feedback signal $FB_A$.

The undelayed electrical output signal 35 for the output transducer 30 (in FIG. 1) or the output block 32 (in FIG. 2) is also fed to the adaptive feedback suppression filter (model) 40 and the model gain estimator 60. The former monitors the output signal and includes an adaptation algorithm adjusting an adaptive digital filter such that it simulates the acoustic feedback path and thereby produces an attenuated and delayed version of the output signal. The filter output $FB_C$ constitutes an estimate of the acoustic feedback signal $FB_A$. The filter output $FB_C$ can be used as a feedback cancellation signal 45, in the way that it is submitted to an inverting input of a summing circuit 50. The summing circuit 50 produces the feedback controlled electrical input signal 25 as the sum of the electrical input signal 15 and the inverted feedback cancellation signal 45. The feedback controlled electrical input signal 25 is then submitted to processor 20 as input signal.

According to an embodiment of the invention, a model gain estimator 60 is provided, to which the electrical output signal 35 and the feedback cancellation signal 45 are submitted. Based on these signals the model gain estimator 60 determines the gain in the model which is then used to derive an upper gain limit 55 which is submitted to processor 20.

According to an embodiment, the adaptive feedback suppression filter 40 is an adaptive digital filter with a certain length and step size. The initial filter coefficients are preferably stored in memory (not shown) of the hearing aid and are loaded into the adaptive feedback suppression filter every time the hearing aid is switched on. With these filter coefficients, the adaptive digital filter is able to generate an initial filter output $FB_C$ which can be used as default feedback cancellation signal 45. Depending on the precision within which the adaptive digital filter can match the acoustic feedback signal $FB_A$, an offset as a so called safety or feedback margin is introduced to the model gain as the estimate of the acoustic feedback gain. This feedback margin represents the gain below the level where audible feedback occurs. For example, a feedback margin of 6 dB is selected which means that the upper processor gain limit is set 6 dB below where audible feedback occurs. After the hearing aid is switched on, the adaptive feedback suppression filter starts with its adaptive modelling to match the acoustic feedback by evaluating the filter coefficients so that an adapted feedback cancellation signal is generated.

Figure 6:
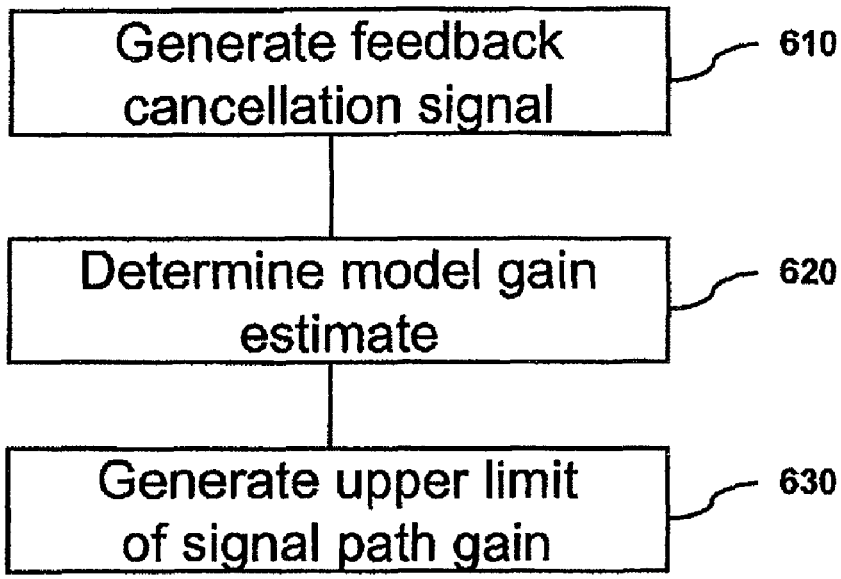
FIG. 6 depicts a flow chart illustrating a method according an embodiment of the present invention.

The function of the adaptive feedback suppression filter is now further explained with reference to the flow chart as described in FIG. 6. First, the feedback cancellation signal 45 is generated in operation 610 to reduce the acoustic feedback of the hearing aid by using the feedback cancellation signal as an error signal to reduce the feedback controlled electrical input signal 25. As part of its adaptive modelling, the adaptive feedback suppression filter 40 yields a certain gain when adjusting its filter coefficients to evaluate the feedback cancellation signal. In operation 620, this gain is determined as model gain estimate and the upper limit of the processor or signal path gain is then generated in operation 630 by taking the model gain estimate as a measure of the level of the acoustic feedback in the hearing aid.

The model gain estimate is determined by continuously estimating the gain in the adaptive feedback suppression filter. The model gain estimation is done by comparing the input signal to the adaptive feedback suppression filter which is the electrical output signal 35 and the output of the adaptive feedback suppression filter which is the feedback cancellation signal 45. This comparison is done by the model gain estimator 60. The model gain and if necessary plus the feedback margin is used to derive the upper processor gain limit. The adaptive feedback suppression filter 40 is also capable of selecting and introducing suitable delays to the signals, e.g. the inputted electrical output signal 35 as part of its adaptive modelling.

The model gain in the adaptive feedback suppression filter is generally negative, as referred to a logarithmic expression, since the feedback signal reaching the microphone is generally an attenuated version of the output signal. The numerical value of this gain, equivalent to $FB_A$, effectively signifies the maximum allowable gain in the processor in a state absent feedback compensation.

From this estimated gain limit a deduction has to be made. As signal distortion will be audible even at loop gains somewhat below 1, a deduction must be made to ensure that the maximum allowable processor gain stays below the stability limit by a margin. This safety or feedback margin will be set according to testing. In one test setup, a margin setting of 6 dB has been found suitable to avoid any audible signal distortion. Thus, in this example, the maximum allowable gain without feedback compensation becomes $FB_A$−6 dB.

In the event the adaptive feedback suppression filter produces a perfect simulation of the feedback transfer function, all feedback will be cancelled, feedback will impose no constraints on the allowable processor gain, and the model provides information about the current feedback path transfer function. In the practical case, however, the adaptive feedback suppression filter produces a less-than-perfect simulation of the feedback transfer function; there will be a residual feedback $$FB_R=FB_A-FB_C$$

reaching the microphone to be picked up and amplified by the processor, and there will be an upper limit to the processor gain in order to avoid instability, i.e. to avoid a loop gain exceeding 1. In particular, the step size and length of the adaptive feedback suppression filter has an effect on the precision within which the acoustic feedback can be matched by the feedback cancellation signal.

The maximum allowable processor gain will be estimated by assessing the level of residual feedback, based on the current information about the feedback transfer function provided by the model.

As the filter e.g. processes a finite time window of signal, it does not take into account the entire signal. In one exemplary test setup, level estimates based on a time window of 1 millisecond (ms) were found to include 80% of the energy of the feedback signal. When basing the feedback compensation on such time windows, it can be expected that the compensation leaves a residual feedback at a magnitude of 25% of the feedback cancellation signal.

As $FB_R=FB_A-FB_C$ and with the filter output signal having a level of 80% of that of the acoustic feedback signal according to this exemplary test setup, $FB_C=0.8\ FB_A$, the residual feedback is:

$$FB_R=FB_A-0.8\ FB_A=0.2\ FB_A.$$

As $FB_A=FB_R+FB_C$, the residual feedback is:

$$FB_R=0.2(FB_R+FB_C),\text{ and thus:}$$

$$FB_R=0.25\times FB_C.$$

In this example, the adaptive feedback suppression filter then raises the limit to maximum allowable gain by a factor of $$FB_C/FB_R=4,$$

equivalent to 12 dB. Thus the maximum allowable processor or signal path gain becomes $-20\log(FB_C)-6\text{ dB}+12\text{ dB}=-20\log(FB_C)+6\text{ dB}$.

As the filter is digital and settings incremental, allowance must particularly be made for the step size, i.e. the finite resolution of the adaptive filter. Accounting for incremental settings and assessing the resulting potential error is considered to lie within the capabilities of those skilled in the relevant art.

According to an embodiment of the present invention, the upper processor gain limit may therefore be determined by the precision of the adaptive feedback suppression filter, the feedback cancellation signal and the safety margin. The person skilled in the art will then evaluate residual feedback $FB_R$ from the feedback cancellation signal and the filter precision. The level of the residual feedback and the safety margin are then be used to derive the upper processor gain limit.

Figure 3:
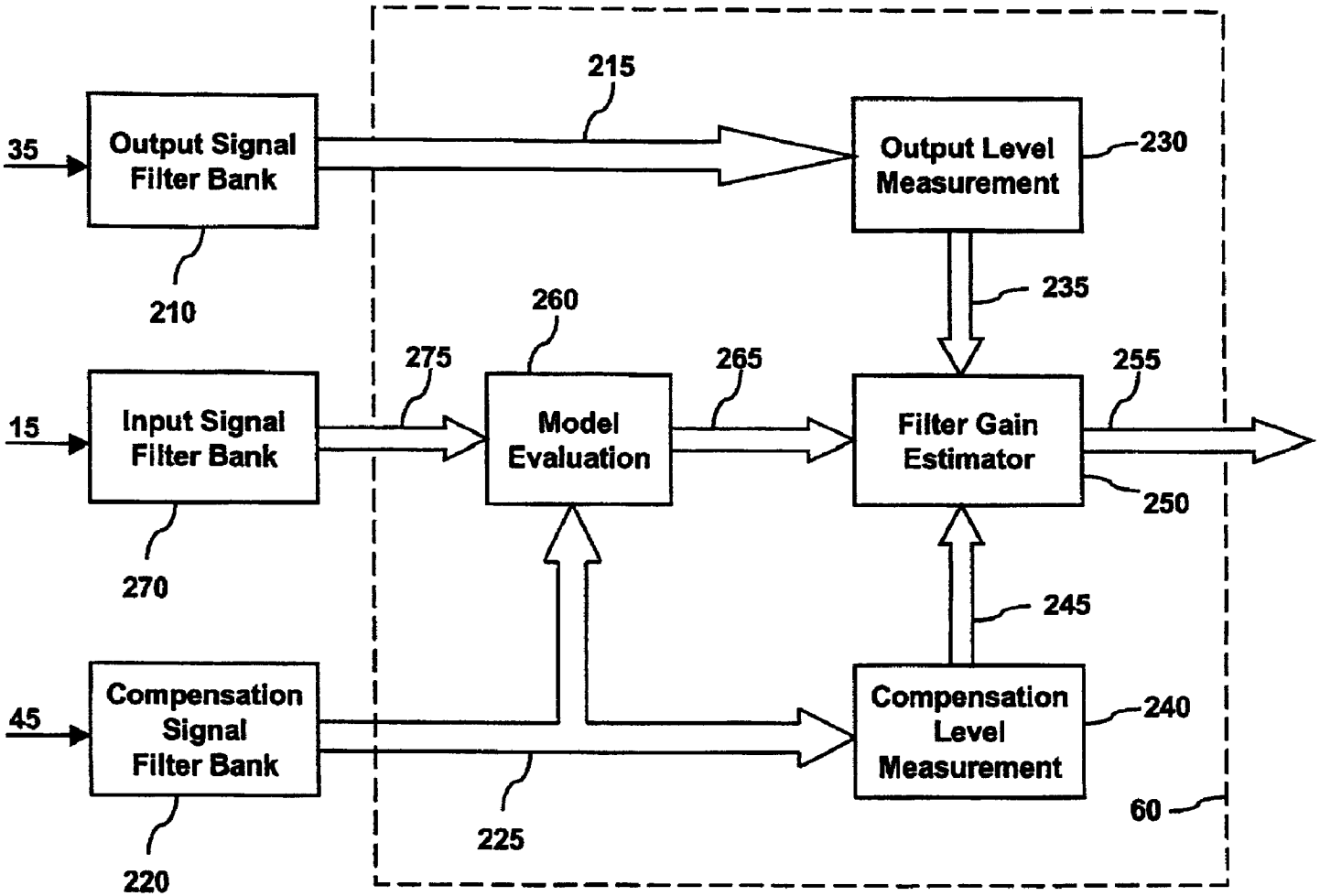
FIG. 3 depicts a block diagram of a model gain estimator according an embodiment of the present invention.

An embodiment of the model gain estimator 60 is shown in detail in FIG. 3 and will now be described. It is assumed that the processor is preceded by an input signal filter bank splitting the feedback controlled electrical input signal 25 into a plurality of frequency bands. This input signal filter bank (not shown in FIGS. 1 and 2) is, according to an embodiment of the present invention, an FFT-circuit or a known filter bank which splits the electrical input signal into respective frequency bands. The same FFT-circuit or filter bank may be used as input signal filter bank 270 splitting the electrical input signal 15 into respective frequency bands which is then fed to the model gain estimator 60. Thus, the input signals to the processor and to the model gain estimator are split into respective frequency bands by using the same filter bank or FFT-circuit so that the error of the estimate can be further reduced.

An output signal filter bank 210 and a compensation signal filter bank 220 produce signal vectors 215, 225 of the electrical output signal 35 and the feedback cancellation signal 45, respectively, in the respective frequency bands. The signal vectors 215, 225 are each fed to the model gain estimator, in which these signal vectors are submitted to an output level measurement circuit 230 and to a compensation level measurement circuit 240, respectively, for generating respective vectors of level measures 235, 245. The level measures are generated by computing a norm of the signal vectors 215, 225 over a predetermined time window as will be described below in more detail. The level measures 235, 245 are submitted to a filter gain estimator block 250 for calculating a vector of ratios between these level measures. The vector of ratios is then assumed to represent a gain estimate in each frequency band. The model gain estimator uses these estimates to derive upper gain limits 55, 255, which are submitted by the gain estimation block 250 to processor 20 (ref. FIG. 1).

The model gain estimator 60 further comprises model evaluation block 260 for measuring the accuracy of the model. The model evaluation block 260 receives a vector of electrical input signals 275 from the input signal filter bank 270 and a vector of feedback cancellation signals from the compensation signal filter bank 220 and generates control parameter 265 to control the filter gain estimator block 250. To generate control parameter 265, the model evaluation block 260 generates and compares a norm of the electrical input signal without feedback compensation to a norm of the feedback controlled electrical input signal. If the norm of the feedback controlled electrical input signal exceeds the norm of the electrical input signal without feedback compensation, the model is most likely misadjusted and the control parameter 265 indicates to take other action. The control parameter 265 may also be a vector of control parameters for each frequency band. Other actions could be to stall or to freeze the gain estimation for a certain amount of time, or it could be to let the gain limits derived from the model gain estimator leak towards a set of default values. Appropriate default values may, e.g., be measured when fitting the hearing aid.

Figure 7:
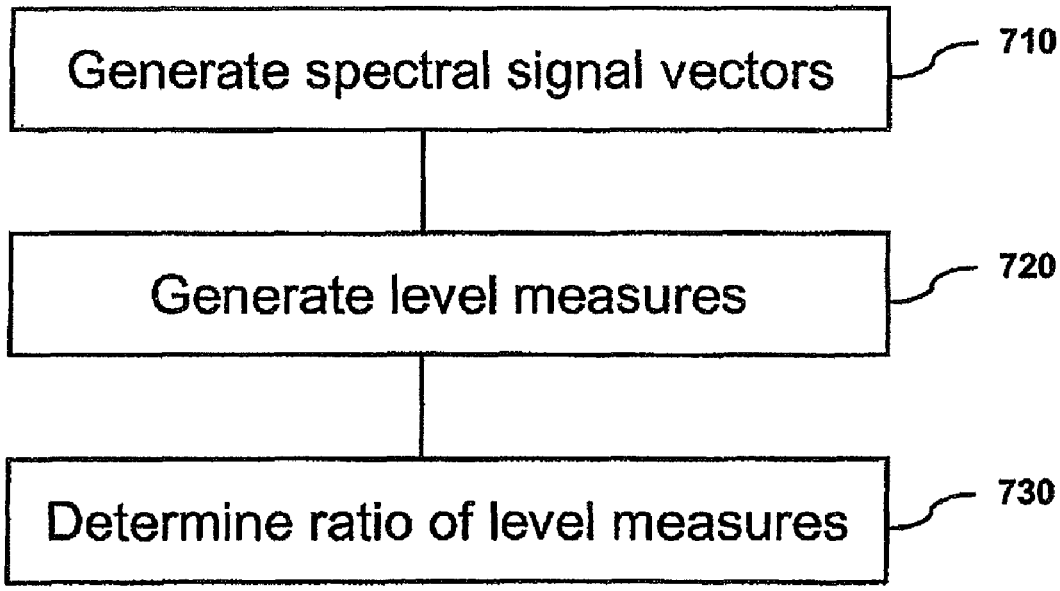
FIG. 7 depicts a flow chart illustrating a method according another embodiment of the present invention.

The function of the model gain estimator is now further explained with reference to FIG. 7. First, in operation 710, signal vectors 215, 225 of the feedback cancellation signal 45 and the electrical output signal 35 are generated by preferably using the same filter bank as used in the signal path of the processor. In operation 720, a level measure is generated from these signal vectors.

According to an embodiment, a simple average of the absolute value of each signal in a certain time frame is taken as the level measure and the time window is rectangular. In a computational low-cost embodiment, the average is calculated by a first order low pass filter, i.e., the time window is exponential.

According to another embodiment, direct energy computation is used to generate the level measure. The level measure is taken by computing an energy measure which is achieved by calculating an average of the squared values of each signal in the signal vectors 215, 225 over a certain time window, where the time window again can be either rectangular or modelled by a first order low pass filter.

The model gain estimate is then generated by determining a ratio between the level measures 235, 245 of said electrical output signal and of the feedback cancellation signal in operation 730. Since the ratio is determined for each frequency band, a vector of gain estimates in respective frequency bands is obtained. These estimates are then used to derive upper spectral processor gain limits in the signal path.

According to an embodiment, the norm signals are calculated according to the general formula:

$$N = \left(\sum_{k=1}^{L} F_k |x_k|^p\right)^{p^{-1}},$$

wherein $x_k$ is the k-th sample (k=1, . . . L) of the signal of which the norm is to be calculated, $F_k$ represents a window or filter function and natural number p is the power of the norm. According to a particular embodiment of this formula p=1 and the filter function $F_k$ is defined by the following recursive formula:

$$N(k)=\lambda|x_k|+(1-\lambda)N(k-1),$$

wherein $\lambda$ is a constant $0<\lambda\leqq 1$.

It should be acknowledged here that according to further embodiments, the present invention may also be implemented as a computer program or an electronic circuit. The computer program then comprises computer program code which when executed on a digital signal processor or any other suitable programmable hearing aid system performs a method of adjusting the signal path gain of a hearing aid device according to any one of the embodiments described herein. The electronic circuit may be realised as an application specific integrated circuit which then may be implemented in a hearing aid system to employ a hearing aid according to any of the embodiments described herein.

We claim:

1. A hearing aid comprising:

an input transducer transforming an acoustic input signal into an electrical input signal;

a processor generating an electrical output signal by amplifying said electrical input signal according to a processor gain;

an output transducer transforming said electrical output signal into an acoustic output signal;

an adaptive feedback suppression filter generating a feedback cancellation signal; and a model gain estimator determining a model gain estimate of the adaptive feedback suppression filter and generating an upper limit of said processor gain, said model gain estimator including a model evaluation block providing a control parameter indicating a possible misadjustment of the model.

2. The hearing aid according to claim 1, comprising an output block delaying the electrical output signal fed to said output transducer.

3. The hearing aid according to claim 1, comprising an input signal filter bank splitting the electrical input signal into frequency bands, wherein said model gain estimator determines said model gain estimate for each of said frequency bands and generates spectral upper gain limits of said processor gain in said frequency bands.

4. The hearing aid according to claim 1, comprising an output signal filter bank generating a spectral signal vector of said electrical output signal, and a compensation signal, filter bank generating a spectral signal vector of said feedback cancellation signal, and wherein said model gain estimator generates a level measure of said spectral signal vectors.

5. The hearing aid according to claim 4, wherein said model gain estimator includes a filter gain estimator generating said model gain estimate by determining a ratio between said level measures of said electrical output signal and of said feedback cancellation signal.

6. The hearing aid according to claim 4, wherein said model gain estimator includes an output level measurement block and a compensation level measurement block generating said level measures of said electrical output signal and of said feedback cancellation signal, respectively, by computing a norm of the signal vectors over a predetermined time window.

7. The hearing aid according to claim 6, wherein said norm is the absolute value of the signal, and said time window is rectangular.

8. The hearing aid according to claim 6, wherein said norm is the absolute value of the signal, and said time window is modelled by a first order low pass filter.

9. The hearing aid according to claim 6, wherein said norm is the squared value of the signal, and said time window is rectangular.

10. The hearing aid according to claim 6, wherein said norm is the squared value of the signal, and said time window is modelled by a first order low pass filter.

11. The hearing aid according to claim 1, wherein said model evaluation block is adapted for comparing a norm of said electrical input signal without feedback compensation with a norm of said feedback controlled electrical input signal to determine a possible misadjustment of the model.

12. The hearing aid according to claim 1, wherein said model gain estimator freezes said model gain estimate or stalls generating said upper limit of said processor gain if said control parameter indicates misadjustment of the model.

13. The hearing aid according to claim 1, wherein the gain limits determined from said model gain estimator leak towards a set of default values if said control parameter indicates misadjustment of the model.

14. A method of adjusting the signal path gain of a hearing aid comprising selecting an input transducer transforming an acoustic input signal into an electrical input signal, a processor generating an electrical output signal by amplifying said electrical input signal with said signal path gain, and an output transducer transforming said electrical output signal into an acoustic output signal;

generating a feedback cancellation signal by an adaptive feedback suppression filter;

determining a model gain estimate of the adaptive feedback suppression filter by evaluating said feedback cancellation signal;

generating an upper limit of said signal path gain by said model gain estimate upon evaluation of said feedback cancellation signal and said electrical output signal; and providing a control parameter indicating a possible misadjustment of the model.

15. The method according to claim 14, wherein said model gain is determined by continuously estimating the gain in an adaptive feedback suppression filter generating said feedback cancellation signal.

16. The method according to claim 14, comprising the steps of:

splitting the electrical input signal into frequency bands;

determining said model gain estimate for each of said frequency bands; and generating spectral upper gain limits of said signal path gain in said frequency bands.

17. The method according to claim 14, comprising the steps of:

generating spectral signal vectors of said electrical output signal and of said feedback cancellation signal; and generating a level measure of said signal vectors.

18. The method according to claim 17, wherein said model gain estimate is generated by determining a ratio between said level measures of said electrical output signal and of said feedback cancellation signal.

19. The method according to claim 17, wherein said level measures are generated by applying an average of the absolute value calculation to the spectral signal vectors.

20. The method according to claim 17, wherein said level measures are calculated by first order low pass filtering of said spectral signal vectors.

21. The method according to claim 17, wherein said level measures are generated by applying a direct energy computation to the spectral signal vectors.

22. The method according to claim 14, comprising the step of comparing a norm of said electrical input signal without feedback compensation with the norm of said feedback controlled electrical input signal to determine a possible misadjustment of the model.

23. The method according to claim 14, comprising the step of freezing the generation of said model gain estimate and/or stalling the generation of said upper limit of said signal path gain if said control parameter indicates misadjustment of the model.

24. The method according to claim 14, wherein the gain limits derived from said model gain estimator leak towards a set of default values if said control parameter indicates misadjustment of the model.

25. The method according to claim 14, wherein the upper gain limit of said signal path gain is determined by the numerical value of the feedback cancellation signal, the precision of the adaptive feedback suppression filter and a safety margin.

26. A computer program comprising program code for performing a method according claim 14.

27. An electronic circuit for a hearing aid comprising:

a processor circuit generating an electrical output signal by amplifying an electrical input signal submitted by an input transducer of said hearing aid with a processor gain;

an adaptive feedback suppression filter circuit generating a feedback cancellation signal to be subtracted from said electrical input signal before said electrical input signal is provided to said processor circuit;

a model gain estimation circuit determining a model gain estimate of the adaptive feedback suppression filter and generating an upper limit of said processor gain, said model gain estimation circuit including a model evaluation block providing a control parameter indicating a possible misadjustment of the model.

* * * * *